US005893200A

United States Patent [19]

Fehrer

[11] Patent Number: 5,893,200

[45] Date of Patent: Apr. 13, 1999

[54] DEVICE FOR NEEDLING A PREBONDED WEB

[76] Inventor: Ernst Fehrer, Auf der Gugl 28, A-4020 Linz, Austria

[21] Appl. No.: 08/924,240

[22] Filed: Sep. 5, 1997

[30] Foreign Application Priority Data

| | | | |
|---|---|---|---|
| Sep. 10, 1996 | [AT] | Austria | 1598/96 |
| Nov. 11, 1996 | [AT] | Austria | 1969/96 |
| Jul. 9, 1997 | [AT] | Austria | 1177/97 |
| Aug. 13, 1997 | [AT] | Austria | 1350/97 |

[51] Int. Cl.[6] ..... D04H 18/00

[52] U.S. Cl. ..... 28/115; 28/107

[58] Field of Search ..... 28/107, 108, 109, 28/110, 111, 112, 113, 114, 115

[56] References Cited

U.S. PATENT DOCUMENTS

| | | | |
|---|---|---|---|
| 2,896,303 | 7/1959 | Morrill | 28/115 |
| 4,977,653 | 12/1990 | Pum | 28/111 |
| 5,117,541 | 6/1992 | Leuchtenmuller | 28/115 |
| 5,148,584 | 9/1992 | Fehrer | 28/115 |
| 5,384,944 | 1/1995 | Minichshofer | 28/115 |
| 5,699,596 | 12/1997 | Fehrer | 28/115 |

*Primary Examiner*—Jeanette Chapman
*Assistant Examiner*—Larry D. Worrell, Jr.
*Attorney, Agent, or Firm*—Collard & Roe, P.C.

[57] ABSTRACT

A device for needling a prebonded web (1), comprises at least one needle board (3) reciprocatingly movable in a stitching direction, a stitch base (2) between a feed roller (6) and a discharge roller (7), which stitch base is located directly opposite the needle board (3) and forms a web guide that is convex in a direction of web movement. The stitch base (2) consists of blades (9) extending transversely to the direction of web movement and having end faces (10) defining a continuously curved enveloping surface. The end faces (10) constituting a web support, and between which blades there engage at least two needle rows extending tranversely to the direction of web movement engage between adjacent blades during their reciprocation.

11 Claims, 3 Drawing Sheets

1
2
3
4
5
6
7
8
9
11
12
13
14
15
16
17
III
III

DEVICE FOR NEEDLING A PREBONDED WEB

BACKGROUND OF THE INVENTION

1. Field of the Invention

This invention relates to a device for needling a prebonded web, comprising at least one needle board reciprocatingly movable in a stitching direction, a stitch base between a feed roller and a discharge roller. The stitch base is located directly opposite the needle board and forming a web guide that is convex in a direction of web movement.

2. Description of the Prior Art

In conventional needling devices the web is guided between the stitch base opposite the needle board and a stripper between the stitch base and the needle board, whose needles stitch into the web through through holes in the stripper. The stripper, which like the stitch base mostly consists of a perforated plate, has the function of retaining the web with respect to the needles emerging from the web, and of preventing the web from being entrained by the barbs of the needles. A conventional stripper between the stitch base and the needle board can, however, only be omitted when the web is urged against the web support against the withdrawal resistance of the needles. For this purpose, the stitch base may be provided with a curvature that is convex in direction of movement, and the web may be subjected to a corresponding tensile stress, which urges the web against the stitch base in cooperation with the convex support, so that the needles can be withdrawn from the web without having to risk that the web is lifted off the stitch base. The tensile stress acting on the web is easily achieved by means of a corresponding difference of the conveying speeds of the feed roller and the discharge roller. The omission of a stripper, which is possible as a result of these measures, makes possible an increased density of the needle distribution, because the needle distance is no longer restricted by the distance of the holes in the stripper, but only when this restriction is not imposed by the stitch base, which should therefore not be designed as a conventional perforated plate.

SUMMARY OF THE INVENTION

It is therefore the object underlying the invention to improve a device for needling a prebonded web as described above such that despite a higher needle density as a result of the omission of a stripper a sufficient penetration of the needles through the web can be ensured.

This object is solved by the invention in that the stitch base consists of blades extending tranversely to the direction of web movement and having end face defining a continuously curved enveloping surface which constitutes a web support, and at least two rows of needles extending tranversely to the direction of web movement engage between adjacent blades.

The web drawn over the stitch base under a suitable tensile stress forms a traverse adapted to the continuously curved enveloping surface, in whose vicinity the web is kept taut, so that the needles can be withdrawn from the web without entraining the web. The web tension between the blades supporting the web in addition facilitates the impingement of the needles, which may be arranged between the blades with a distribution density that merely depends on the strength conditions in the vicinity of the needle board. Since at least two rows of needles extending tranversely to the direction of web movement engage between two succeeding blades of the stitch base, a sufficient needle density over the needle area can easily be ensured, so as to obtain a uniform stitch pattern independent of the feed rate of the web during needling, with a high degree of felting.

The blades of the stitch base may be milled out of a plate, which requires, however, a correspondingly convex plate. Simpler manufacturing conditions are obtained when the blades consist of individual ribs of graduated height, which due to their graduated height define a continuously curved enveloping surface. By means of a rib height gradually decreasing from the center of the rib towards the ends there can in addition be achieved a guidance of the web acting against the width shrinkage resulting from needling.

The edge blades on the side of the inlet and the outlet may advantageously have a larger width than the intermediate blades and constitute a deflection guide for the incoming and outgoing web. The larger width of the edge blades not only produces a higher strength of the stitch base, but also an improved guidance of the web in direction of web movement. The deflection of the incoming and outgoing web at the edge blades in addition ensures a proper abutment of the web at these edge blades, which is an essential condition for a uniform needling.

The tension at which the web is drawn over the convex stitch base generates a corresponding pressure with which the web is urged against the blades. Due to the restriction of the applicable tensile load, the resistance to a withdrawal of the needles from the web can, however, lead to the web being locally lifted off the blades, in particular in the middle portion of the stitch base. Therefore, a stripper blade may be associated with at least one middle blade, which stripper blade prevents the web from being lifted off the stitch base, which would impair the needling, without disturbing the distribution density of the needles. To satisfy most needling conditions, a stripper blade may likewise be associated, by way of precaution, not only to the middle blade, but also to at least one of the two edge blades. Particularly advantageous guiding conditions for the web are obtained in this connection when the blades of the stitch base associated with the stripper blades have a larger width than the remaining blades of the stitch base, which provides for a corresponding design of the stripper blades.

The constructive arrangement of the stripper blades may be chosen differently. To be able to operate with a minimum constructional effort, the stitch base may carry cheeks for supporting the stripper blade(s), which cheeks are vertically adjustable in stitching direction. Separate supports for the stripper are therefore omitted. Nevertheless, the stripper blades may be vertically adjusted with respect to the stitch base via the cheeks for adjusting the guiding gap.

The measure of using needles with offset or graduated working portions in a suitable distribution over the entire needle area of the needle board advantageously utilizes the fact that the resistance to a withdrawal of the individual needles from the web is different due to the position of their working portion provided with barbs in dependence on the lifting position of the needle board, because as a result of the position of these working portions graduated in groups the same engage in the web with a different number of barbs. For this reason, there can be reduced the withdrawal resistance of all needles engaging in the web, which acts in the sense of lifting the web off the stitch base. The working portions of the one group of needles, which are located closer to the needle board, are withdrawn from the web before the working portions of the other group of needles, so that the number of barbs simultaneously disposed in the web is reduced. The largely uniform distribution of the needles with mutually offset working portions over the entire needle area of the needle board prevents a local agglomeration of needles of uniform working portions and thus a locally increased withdrawal resistance of the needles, which may give rise to a distortion of the web.

For utilizing the different withdrawal resistances of the individual needles with respect to the penetration depth of the working portions, it is recommended to adapt the groupwise offset of the working portions of the needles at least to the thickness of the web to be needled, so that during the withdrawal movement subsequent to the lower return point of the needles the working portions of the one group of needles farther away from the needle board are only moved into the web when the working portions of the other group of needles located closer to the needle board already emerge from the web.

Offset offset working portions are obtained in the case of needles of equal length for instance as a result of the graduated position of the barbs with respect to the needle tip. Particularly advantageous constructional conditions can be achieved in that the needles with mutually offset working portions have different lengths for each group. The needles of different lengths have the advantage that the friction of the needles outside the working portions can additionally be taken into account.

Due to the arrangement of additional supporting elements between the blades a direct web support in the vicinity of the needle impingements can be ensured, provided that these supporting elements can resiliently evade the needle tips or be pierced by the needle tips with a resilient displacement of material. These supporting elements thus prevent that upon impingement of the needles the web can be drawn into the spaces between the blades while the tensile stress is increased, so that the tensile stresses acting on the web are not only reduced, but there are also created particularly favorable stitching conditions, because the web is supported on the supporting elements directly beside the needle tips against an entrainment by the needles. Despite the supporting elements, the advantage of the stitch base consisting of blades is not impaired, because the blades still determine the course of the web in direction of web movement.

The supporting elements may consist of brush elements with bristles extending at least substantially in stitching direction. Particularly advantageous needling conditions are obtained when the supporting elements are constituted by a supporting element to be pierced by the needle tips with a resilient displacement of material, where for instance foams or elastomers may be used as supporting elements. By means of such supporting elements there can be achieved a direct support of the web in the vicinity of the needle impingements, so that an additional tensile stress of the web upon impingement of the needles is avoided, namely independent of the distribution density of the needles, which penetrate into the supporting element with a resilient displacement of material. The stitch channels formed with the repeated locally limited impingements represent the respective needle distribution and provide for advantageous ways of guiding the needles in the vicinity of the stitch base.

BRIEF DESCRIPTION OF THE DRAWING

In the drawing, which illustrates the subject-matter of the invention by way of example.

DETAILED DESCRIPTION OF PREFERRED EMBODIMENTS

Figure 1:
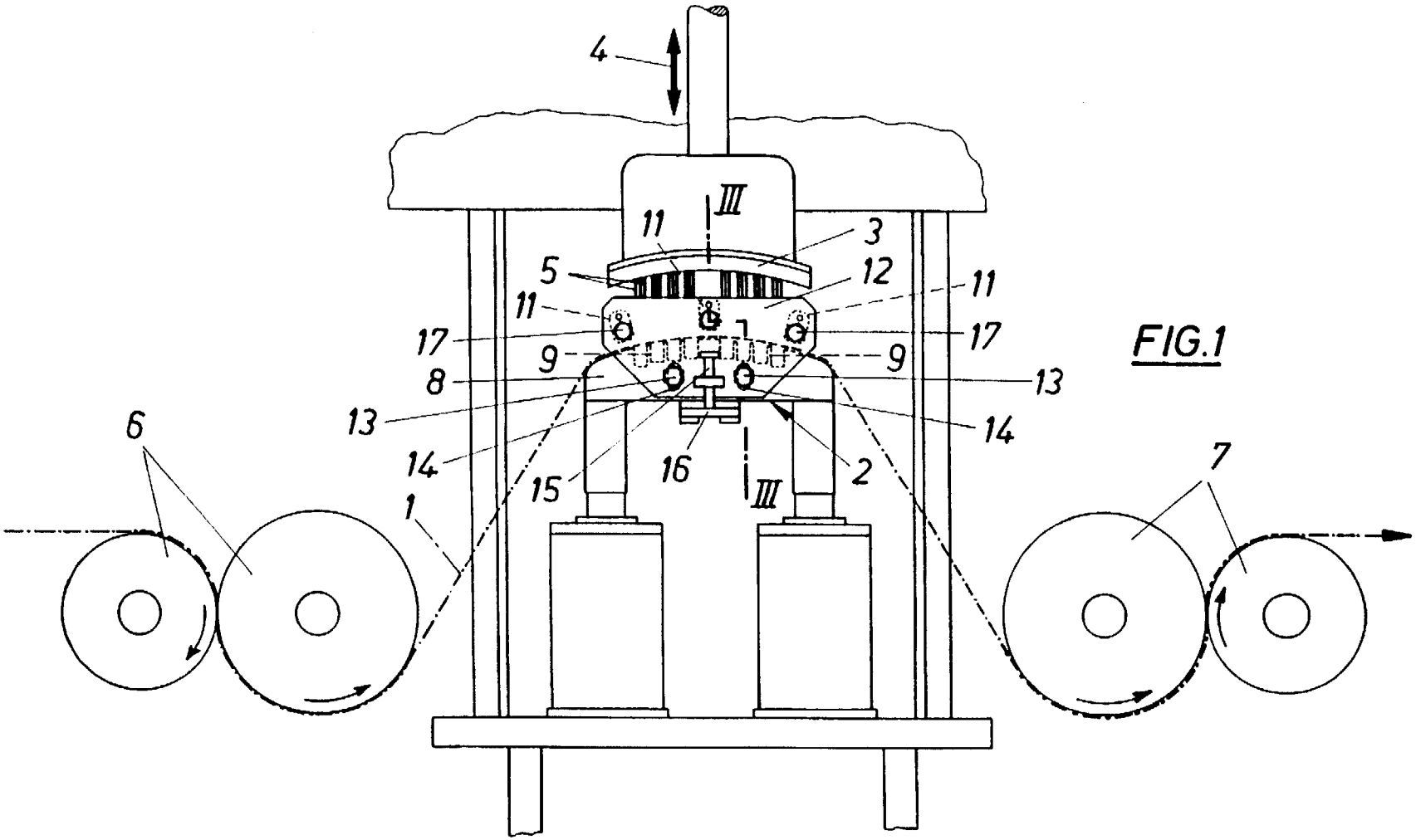
FIG. 1 illustrates an inventive device for needling a web in a simplified fragmentary side view.
Figure 2:
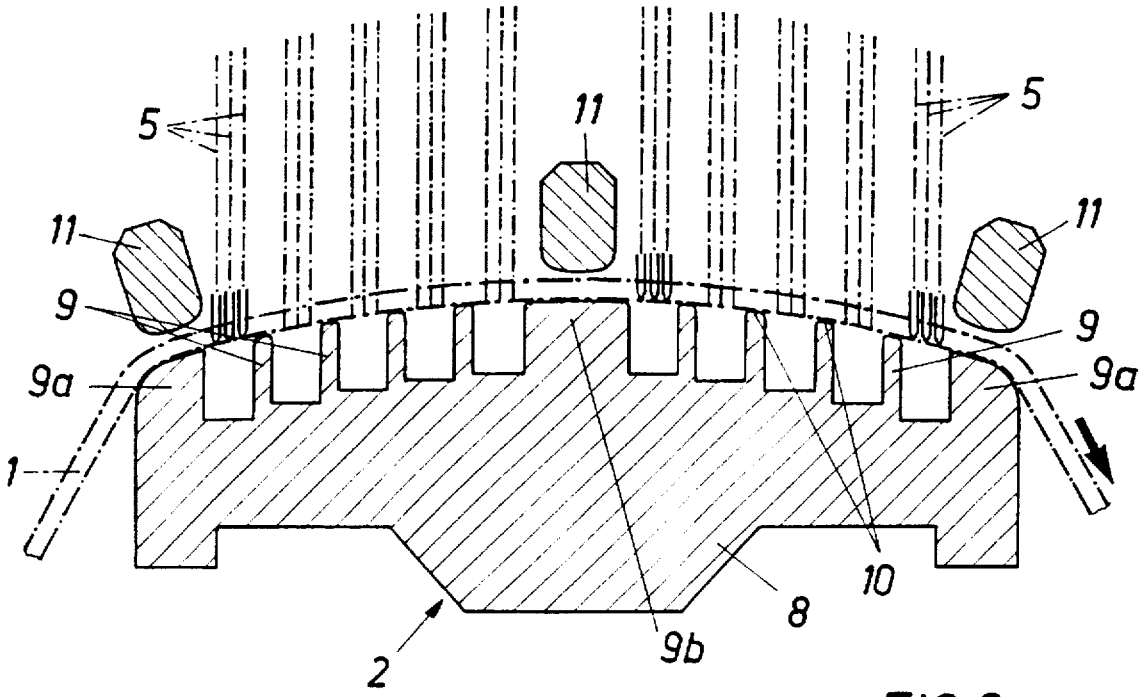
FIG. 2 illustrates the device in the vicinity of the stitch base in a section in direction of web movement on an enlarged scale.
Figure 3:
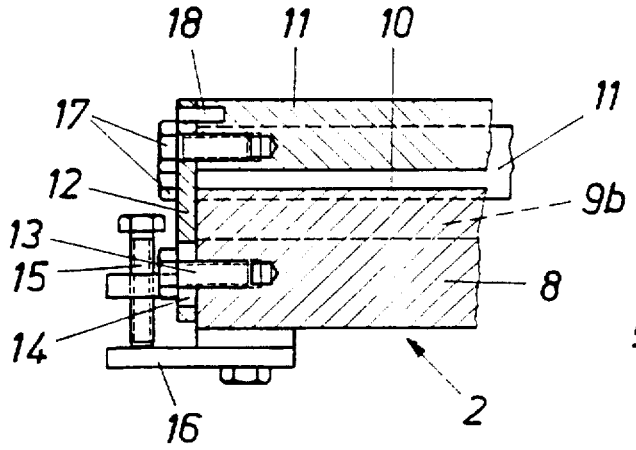
FIG. 3 shows a section along line III—III of FIG. 1, likewise on an enlarged scale.

The device for needling a prebonded web 1, which is represented in FIG. 1 to 3, substantially consists of a stitch base 2 and a needle board 3 disposed above the stitch base 2, which needle board is reciprocatingly movable tranversely to the stitch base 2, as is indicated by the arrow 4. The needles of the needle board 3 are designated with 5. The stitch base 2 has a convex curvature in a direction of web movement, and a tensile stress is applied onto the web 1 between a feed roller 6 and a discharge roller 7, which for this purpose is driven at a larger peripheral speed than the feed roller 6.

As shown in FIG. 2, the stitch base 2 consists of a base plate 8 with blades 9 extending tranversely to the direction of web movement, and having end faces defining a continuously curved enveloping surface to constitute a web support. The web 1 is therefore drawn over the blades 9 in the form of a traverse, and the wider edge blades **9*a* constitute a deflection guide with the effect that due to this deflection the web 1 lies flat against the stitch base 2 both in the inlet area and in the outlet area. As a result of the tensile stress acting on the web 1 between the feed roller 6 and the discharge roller 7 there is produced a pressure urging the web 1 against the blades 9 to the convex stitch base 2, so that the occurring normal forces act against the resistance to a withdrawal of the needles 5 from the web 1. Despite these normal forces, in particular in the case of a high distribution density of the needles 5, which impinge between the individual blades 9 in several needle rows, the web 1 may be lifted off the blades 9 above all in the middle portion of the stitch base 2, which impairs the needling result, in particular when only comparatively small tensile stresses should be applied onto the web 1. For this reason, a stripper blade 11 is associated with a middle blade 9*b*, which stripper blade prevents the web 1 from being lifted off the blades 9 and 9*b*, respectively, in the middle portion of the stitch base 2, which would impair the needling result. Stripper blades 11 may likewise be associated with the edge blades 9*a*, to ensure a particularly good guidance of the web in the needling area. These stripper blades 11 do, however, not prevent the desired high needle distribution density, because they do not protrude into the needle path of the needle rows between the individual blades 9. The middle blade 9*b* of the stitch base 2 has a larger width like the edge blades 9*a*, so that the associated stripper blade 11 can be dimensioned large enough. Moreover, the larger extension of the guiding gap between the stripper blades 11 and the associated blades 9*a*, 9*b* of the stitch base 2** involves a better guidance of the web in direction of web movement.

The attachment of the stripper blades 11 can easily be effected by means of cheeks 12, which are mounted vertically adjustable on the lateral end faces of the base plate 8 of the stitch base 2. For this purpose, the fastening screws 13 extend through oblong holes 14 in the cheeks 12, as this can be seen in particular from FIG. 3. The vertical adjustment itself is effected by means of adjusting screws 15, which are supported on a bracket 16 associated with the base plate 8. The stripper blades 11 themselves are fixed between the two lateral cheeks 12 on the end faces by means of screws 17. The fixation of the stripper blades 11 is achieved by means of a locking pin 18.

Figure 4:
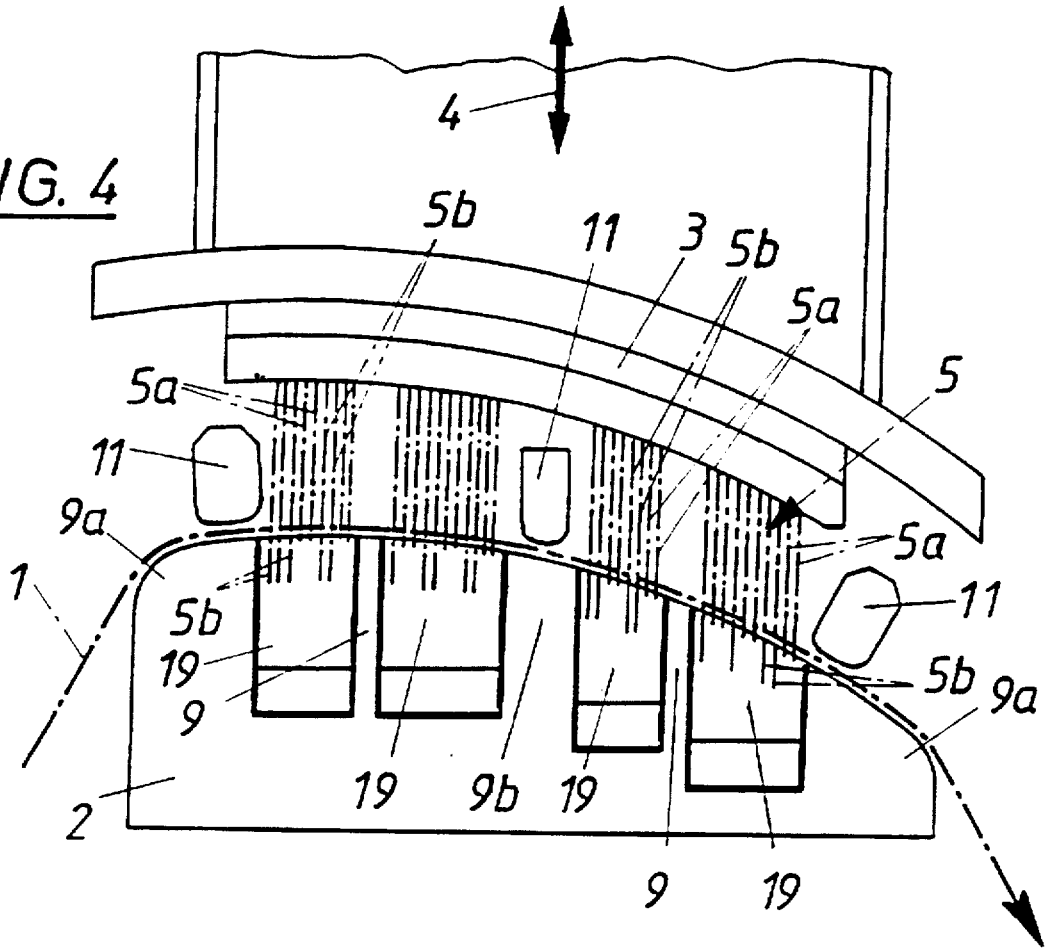
FIG. 4 illustrates a modified embodiment of an inventive device in a simplified fragmentary side view.

To improve the web support in the immediate area of impingement of the needles 5 into the web 1, there are provided supporting elements 19 between the blades 9, as shown in FIG. 4, which supporting elements bridge the space between the blades 9, 9*a* and 9*b* and constitute an additional support for the web 1. These supporting elements 19, which for instance consist of an elastomer, may be pierced by the tips of the needles 5 with a resilient displacement of material and permit a very dense needle distribution, so that particularly advantageous needling conditions are obtained, all the more so as the needles 5 penetrating into the web 1 do not effect any additional tensile stresses acting on the web 1. Moreover, the supporting elements 19 contribute to an absorption of vibrations, which leads to a noticeable muffling of noises.

To also reduce the influence of the tensile forces, which are exerted on the web 1 during the withdrawal of the needles 5 from the web 1, on the distortion of the web 1, which is in particular important in the case of a high distribution density of the needles 5 because of the then comparatively high total resistance to a withdrawal of the needles 5 from the web 1, there are provided two groups of needles 5*a* and 5*b* with working portions offset in stitching direction. For this purpose, the barbs defining the respective working portion might by graduated with respect to each other with the same needle length. In accordance with the illustrated embodiment, however, there are provided two groups of needles 5*a* and 5*b* with different lengths, where the working portions with the barbs extend directly from the needle tip. The needles 5*b* are longer than the shorter needles 5*a* at least by the thickness of the web 1 to be needled. With this measure it is achieved that first the shorter and only then the longer needles 5*a* and 5*b*, respectively, are withdrawn from the web 1. Since above all the barbs provided for the entrainment of fibers upon impingement define the withdrawal resistance of the individual needles 5*a*, 5*b*, the barbs of the longer needles 5*b* that have penetrated deeper into the supporting elements 19 through the web 1 can only act on the web 1 when the barbs of the shorter needles 5*a* have already emerged from the web 1 at least in part. This means that in contrast to needles 5 of equal lengths provided with corresponding working portions the barbs of the shorter and the longer needles 5*a* and 5*b* are withdrawn from the web 1 one after the other, which due to the resulting reduction of the barbs acting on the web 1 at the same time necessarily leads to a reduction of the tensile stress acting on the web 1 in the sense of a lift-off from the stitch base 2. It is, however, necessary that local agglomerations of needles 5*a* and 5*b* of uniform length are avoided, so that a largely uniform distribution both of the shorter needles 5*a* and of the longer needles 5*b* over the entire needle area of the needle board 3 is required.

Figure 5:
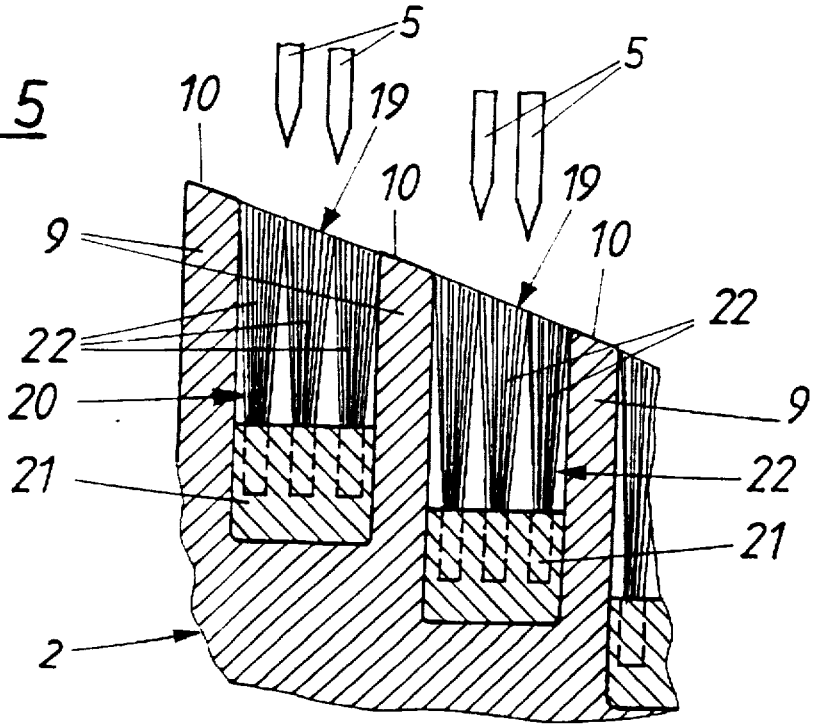
FIG. 5 illustrates a different embodiment as compared to FIG. 4 of a stitch base with brush elements as supporting elements in a fragmentary section in direction of web movement on an enlarged scale.

Instead of the supporting elements 19, which consist of a material to be pierced by the needle tips with a resilient displacement of material, for instance of an elastomer or a foam, the supporting elements 19 may also be formed of brush elements 20 as shown in FIG. 5, where the bristle clusters 22 inserted in brush carriers 21 form the web support between the blades 9 without impeding the needle impingement, because the individual bristles aligned in stitching direction can laterally evade the tips of the needles 5.

I claim:

1. A device for needling a prebonded web, which comprises (a) a feed roller feeding the prebonded web in a direction of web movement, (b) a discharge roller receiving the prebonded web, (c) at least one needle board reciprocatingly movable in a stitching direction, and (d) a stitch base arranged between the feed roller and the discharge roller, the stitch base being positioned directly opposite the needle board and facing the needle board, (1) the stitch base consisting of blades extending tranversely to the direction of web movement and having end faces defining a continuously curved, convex enveloping surface forming a web support, and (2) the needle board carrying rows of needles extending tranversely to the direction of web movement, the rows of needles being arranged so that at least two of said rows of needles engage between adjacent ones of said blades.

2. The device of claim 1, wherein the blades are ribs of graduated height.

3. The device of claim 1, wherein the blades include edge blades respectively adjacent the feed roller and the discharge roller, the edge blades having a larger width than intermediate blades arranged between the edge blades, the edge blades constituting deflection guides for the prebonded web.

4. The device of claim 3, further comprising a stripper blade between the needle board and the stitch base, the stripper blade being aligned with a center blade of the stitch base.

5. The device of claim 4, further comprising two stripper blades between the needle board and the stitch base, the stripper blades being aligned with the edge blades of the stitch base.

6. The device of claim 5, wherein the stitch base carries cheeks supporting the stripper blades, the cheeks being adjustable in the stitching direction.

7. The device of claim 1, wherein the needles have a working portion comprising a barb for the entrainment of fibers in the prebonded web, the needle board carrying at least two groups of said rows of needles and the working portions of the needles in said groups being offset in the stitching direction, and each group being substantially uniformly distributed over an area of the needle board carrying the needles.

8. The device of claim 7, wherein the working portions of the needles in said groups are offset corresponding at least to the thickness of the prebonded web.

9. The device of claim 7, wherein the needles in said groups have different lengths.

10. The device of claim 1, further comprising supporting bodies for the prebonded web, the supporting bodies being arranged between adjacent ones of the blades of the stitch base and being resiliently displaceable by the reciprocatingly movable needles.

11. The device of claim 1, further comprising supporting bodies for the prebonded web, the supporting bodies being arranged between adjacent ones of the blades of the stitch base and being of a material resiliently yielding when pierced by the reciprocatingly movable needles.

* * * * *